US007825320B2

(12) United States Patent
Yatsui

(10) Patent No.: US 7,825,320 B2
(45) Date of Patent: Nov. 2, 2010

(54) ELECTRONIC KEYBOARD MUSICAL INSTRUMENT FOR ASSISTING IN IMPROVISATION

(75) Inventor: Akio Yatsui, Hamamatsu (JP)

(73) Assignee: Yamaha Corporation (JP)

( * ) Notice: Subject to any disclaimer, the term of this patent is extended or adjusted under 35 U.S.C. 154(b) by 12 days.

(21) Appl. No.: 12/126,252

(22) Filed: May 23, 2008

(65) Prior Publication Data

US 2008/0289480 A1 Nov. 27, 2008

(30) Foreign Application Priority Data

May 24, 2007 (JP) ..... 2007-138184

(51) Int. Cl.
*G10H 7/00* (2006.01)

(52) U.S. Cl. ..... 84/613; 84/609; 84/610; 84/634; 84/637; 84/650; 84/666; 84/669

(58) Field of Classification Search ..... None
See application file for complete search history.

(56) References Cited

U.S. PATENT DOCUMENTS

| | | | | |
|---|---|---|---|---|
| 5,260,510 | A * | 11/1993 | Shibukawa | 84/637 |
| 5,322,966 | A * | 6/1994 | Shimaya | 84/637 |
| 5,442,129 | A * | 8/1995 | Mohrlok et al. | 84/637 |
| 5,510,572 | A * | 4/1996 | Hayashi et al. | 84/609 |
| 5,900,567 | A * | 5/1999 | Fay et al. | 84/613 |
| 5,990,407 | A * | 11/1999 | Gannon | 84/613 |
| 6,448,486 | B1 * | 9/2002 | Shinsky | 84/613 |
| 7,297,859 | B2 * | 11/2007 | Ueki et al. | 84/613 |
| 7,465,866 | B2 * | 12/2008 | Ueki et al. | 84/613 |
| 2003/0033925 | A1 * | 2/2003 | Smith | 84/669 |
| 2004/0112203 | A1 * | 6/2004 | Ueki et al. | 84/613 |
| 2007/0240559 | A1 * | 10/2007 | Hasebe | 84/637 |
| 2008/0028919 | A1 * | 2/2008 | Ueki et al. | 84/613 |

FOREIGN PATENT DOCUMENTS

JP 2004-206073 A 7/2004

OTHER PUBLICATIONS

English abstract of page extracted from the journal of Information Processing Society of Japan; IPSJ-JNL4302007.
English abstract of page extracted from the journal of Information Processing Society of Japan; IPSJ-JNL4603019.

* cited by examiner

*Primary Examiner*—Marlon T Fletcher
(74) *Attorney, Agent, or Firm*—Rossi, Kimms & McDowell LLP

(57) ABSTRACT

A musical keyboard includes a plurality of white keys and black keys. As a number of keys are depressed simultaneously, a pattern of the depressed keys is judged as categorized in a number of predetermined patterns of depressed keys in view of the white keys and the black keys based on the input note data acquired from the depressed keys. A plurality of types of harmonization are predetermined, from among which a type of harmonization is determined. According to the determined type of harmonization, the input note data representing the notes of the depressed keys are adjusted so that inadequate notes included in the input notes are changed to adequate notes to constitute a chord as permitted by the type of harmonization in view of musical grammar. An unskilled player can play music incorporating improvisation which would need higher musical skill, as the inadvertently erroneous depression of the keys is rectified in the note data processing.

12 Claims, 10 Drawing Sheets

Hardware Configuration of Electronic Keyboard Musical Instrument

*Fig. 1* Hardware Configuration of Electronic Keyboard Musical Instrument
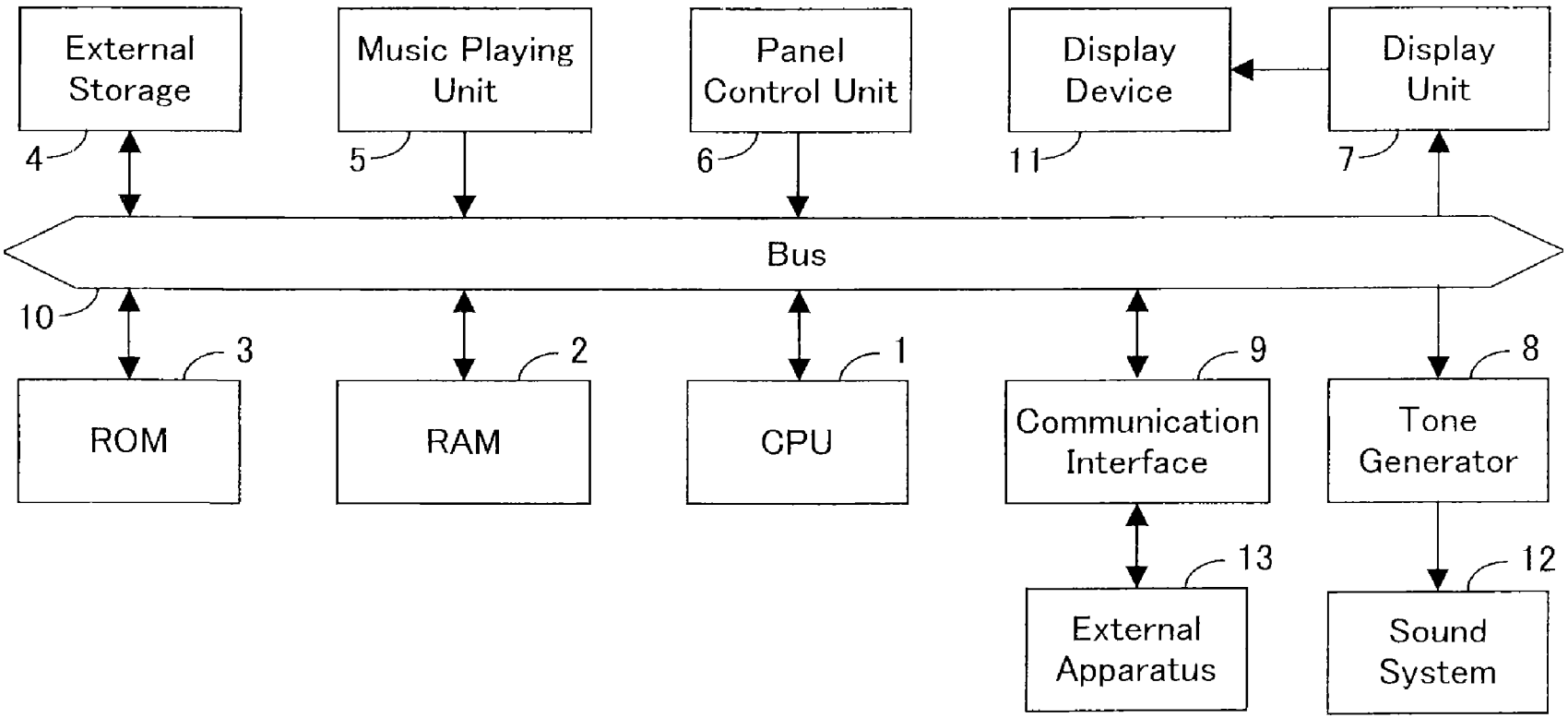

*Fig.2a* Note Names of Keys in Keyboard
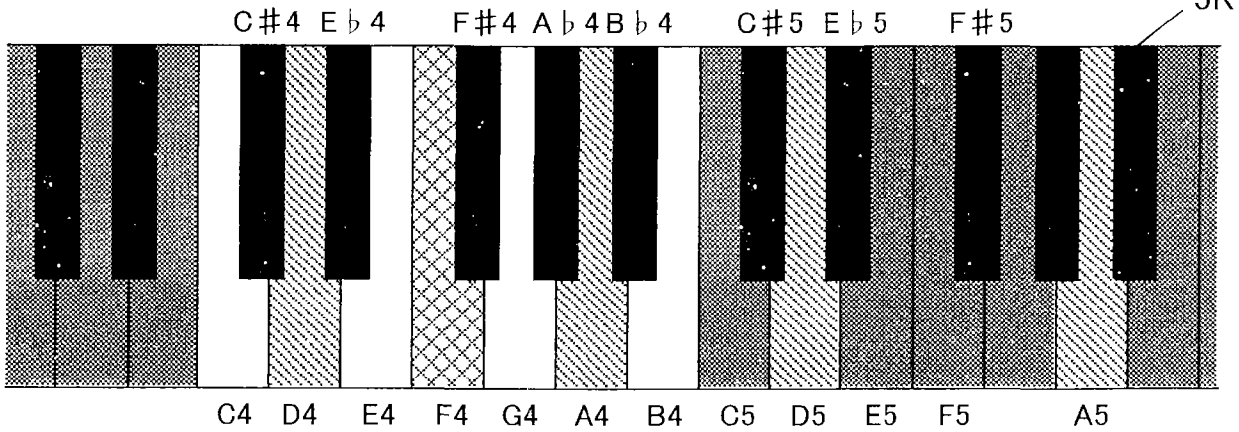
*Fig.2b* Correspondence beween Keyboard and Scale-Characteristic Notes
(In the Case of CM Scale and CM7 Chord)
| | C4 | C#4 | D4 | E♭4 | E4 | F4 | F#4 | G4 | A♭4 | A4 | B♭4 | B4 | D5 | A5 |
|---|---|---|---|---|---|---|---|---|---|---|---|---|---|---|
| Chord Note | Cn | | | | Cn | | | Cn | | | | Cn | | |
| Tension Note | | | Tn | | | | | | | Tn | | | Tn 9th | Tn 13th |
| Avoid Note | | | | | | An | | | | | | | | |
| Chromatic Note | | Cr | | Cr | | | Cr | | Cr | | Cr | | | |
| Blue Note | | | | Bn | | | Bn | | | | Bn | | | |

*Fig.3* Functional Block Diagram
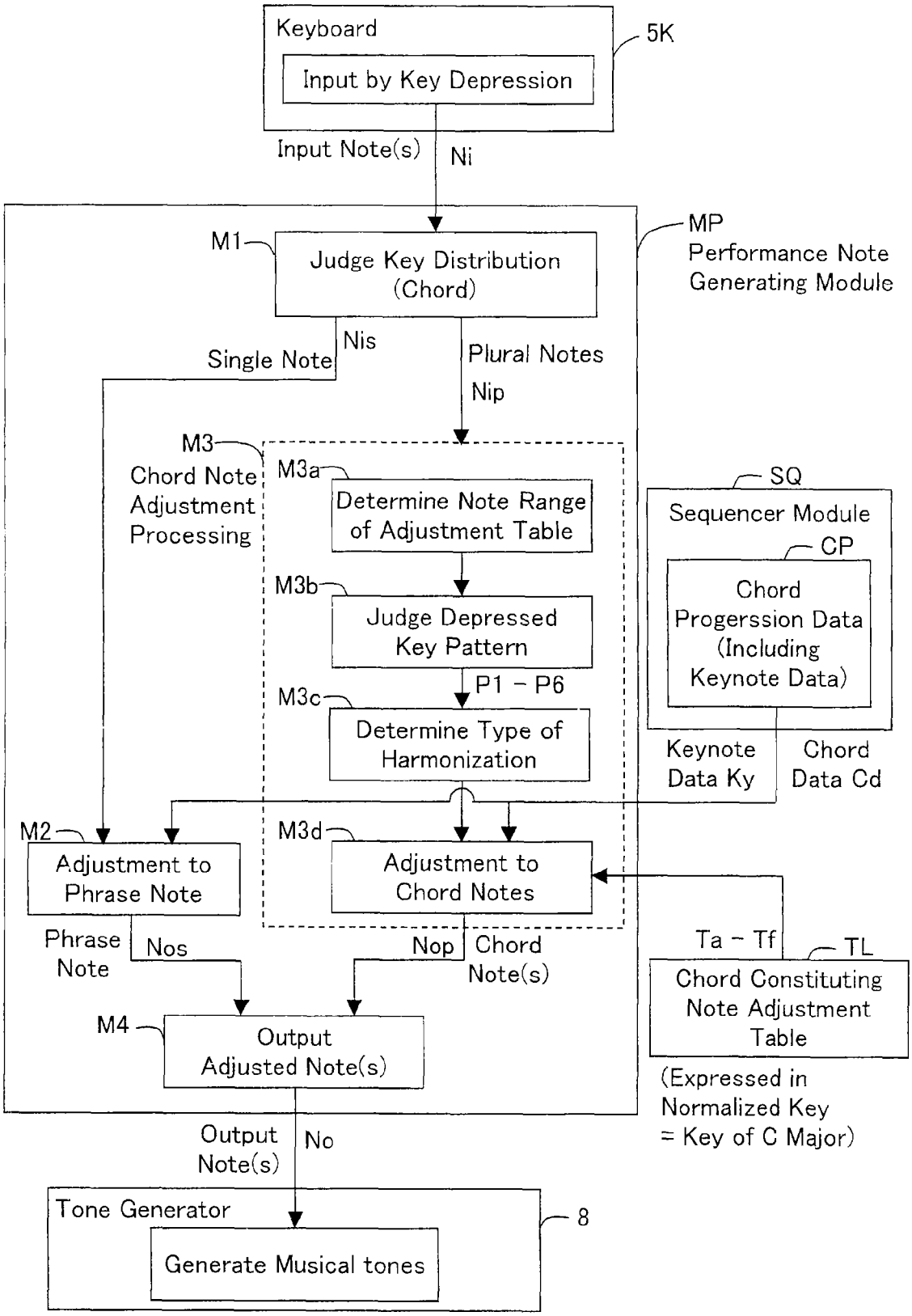

*Fig.4* Chord Note Adjustment Processing
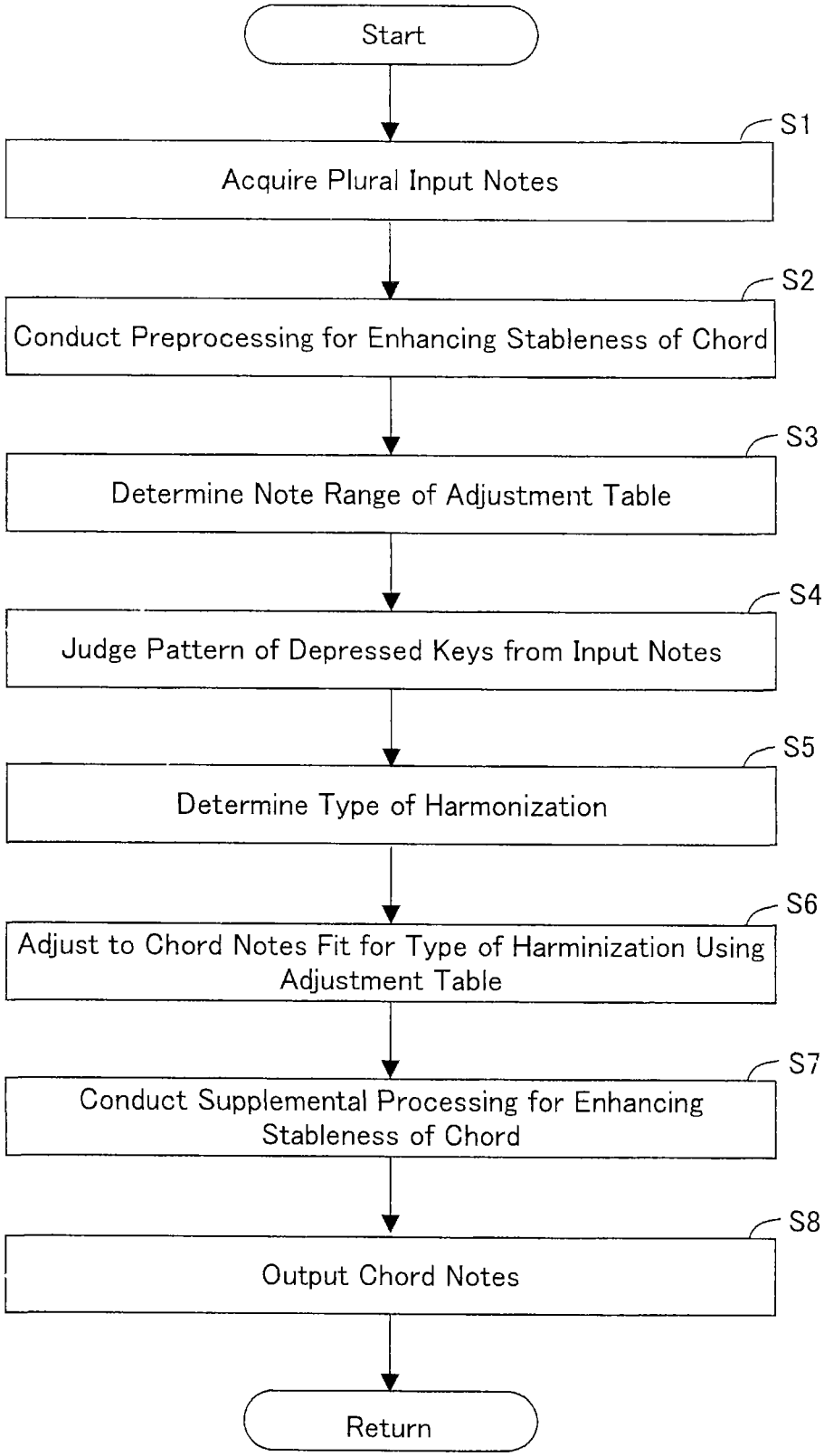

*Fig. 5a* Depressed Key Patterns Featured in General (Feature Description in Parentheses)
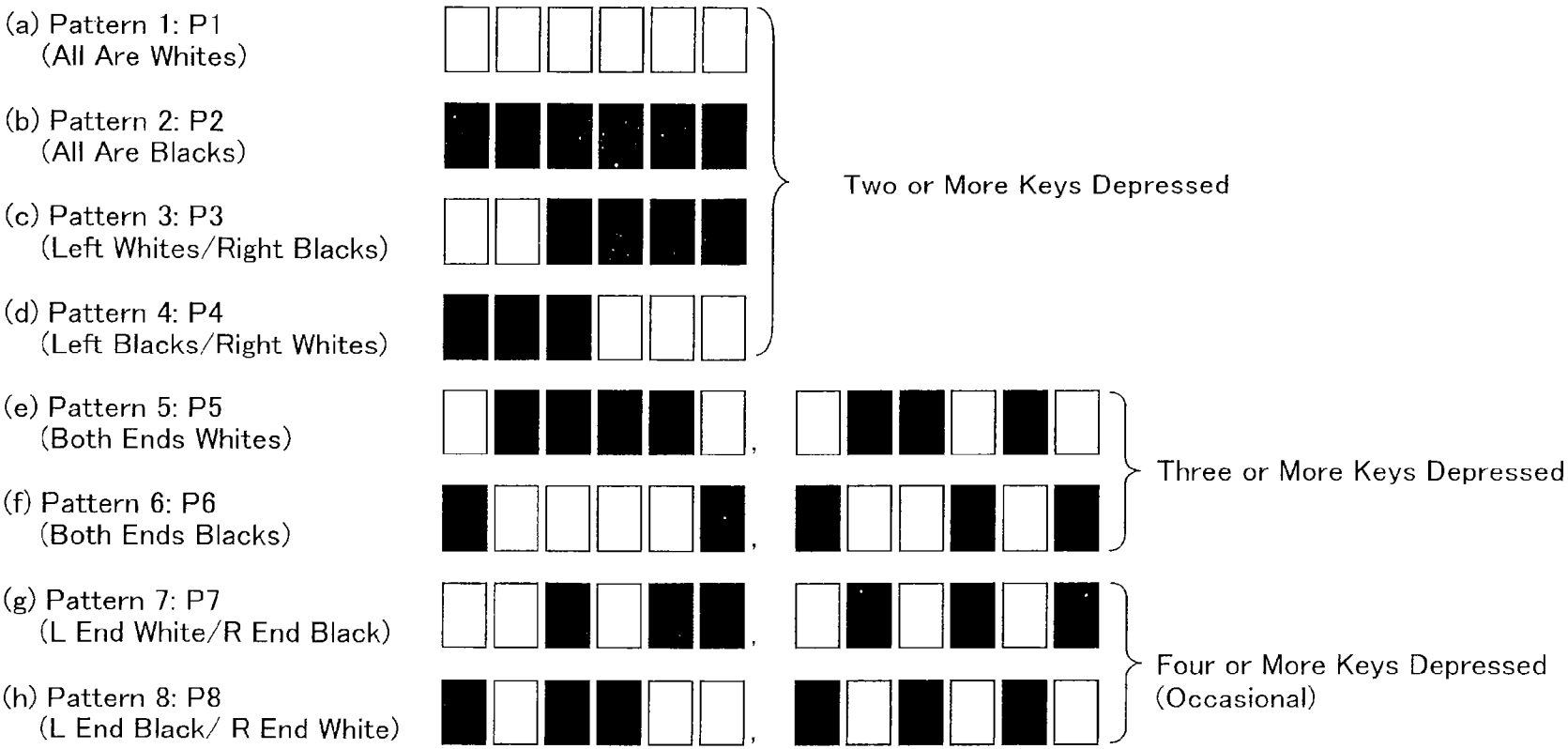

*Fig.5b* Depressed Key Patterns Featured by Position of Blacks (Feature Description in Parentheses)
All for Two or More Keys Depressed
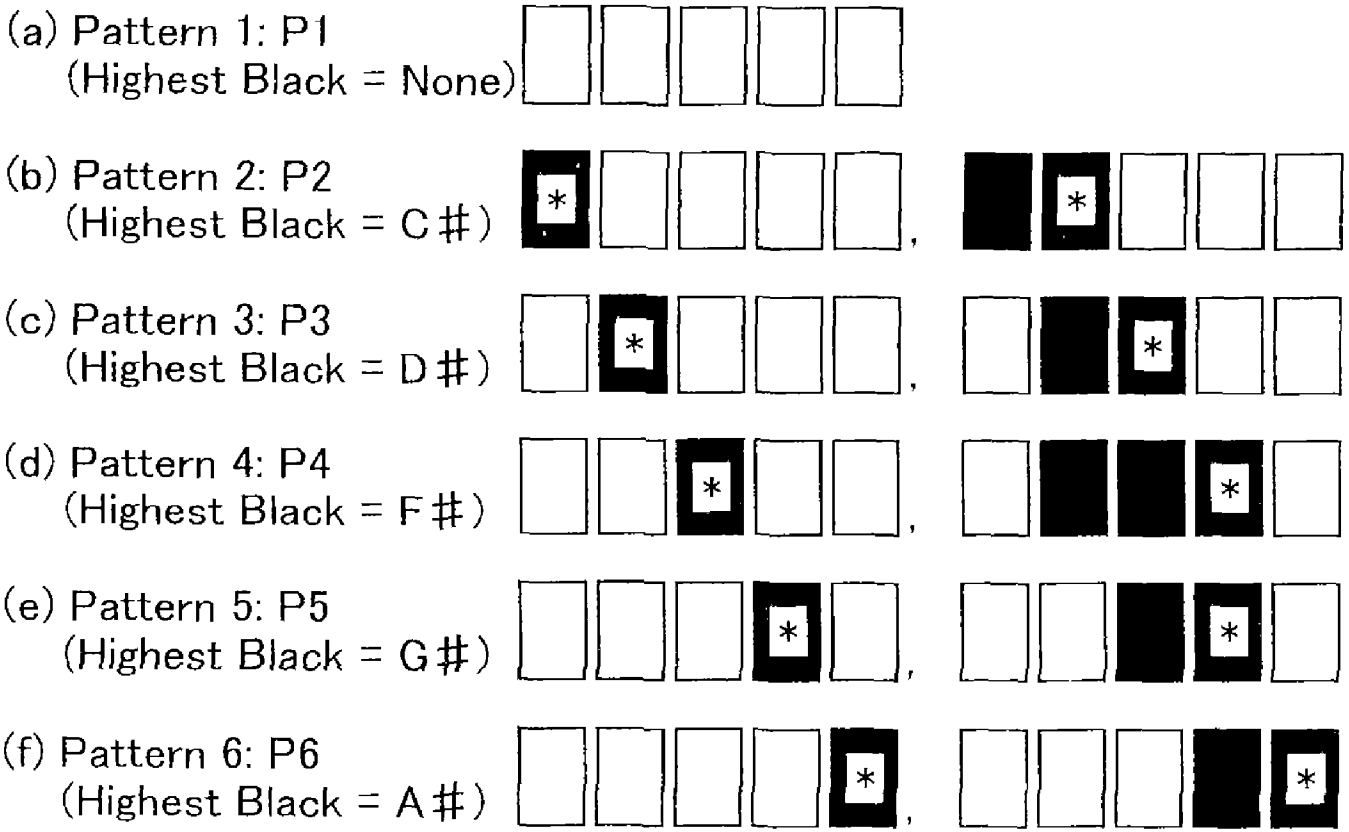

*Fig.5c* Depressed Key Patterns Featured by Number of Blacks (Feature Description in Parentheses)
(a) Pattern 1: P1
(Two or More with No Black)
(b) Pattern 2: P2
(Two or More with One Black)
(c) Pattern 3: P3
(Two or More with Two Blacks)
(d) Pattern 4: P4
(Three or More with Three Blacks)
(e) Pattern 5: P5
(Four or More with Four Blacks)
(f) Pattern 6: P6
(Five or More with Five Blacks)
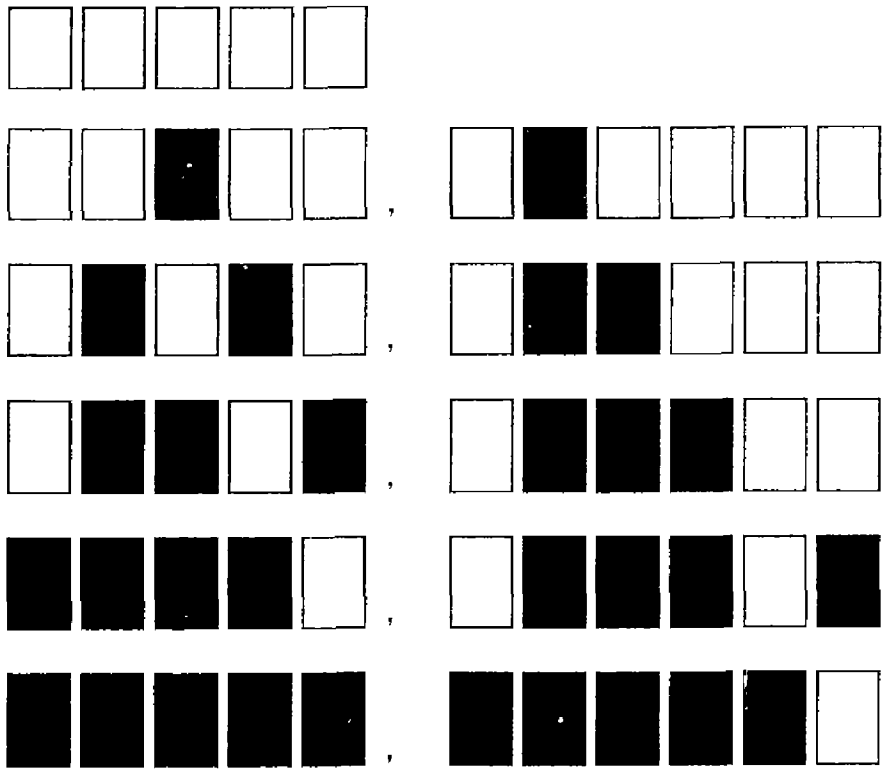

*Fig.6* Depressed Key Patterns versus Types of Harmonization
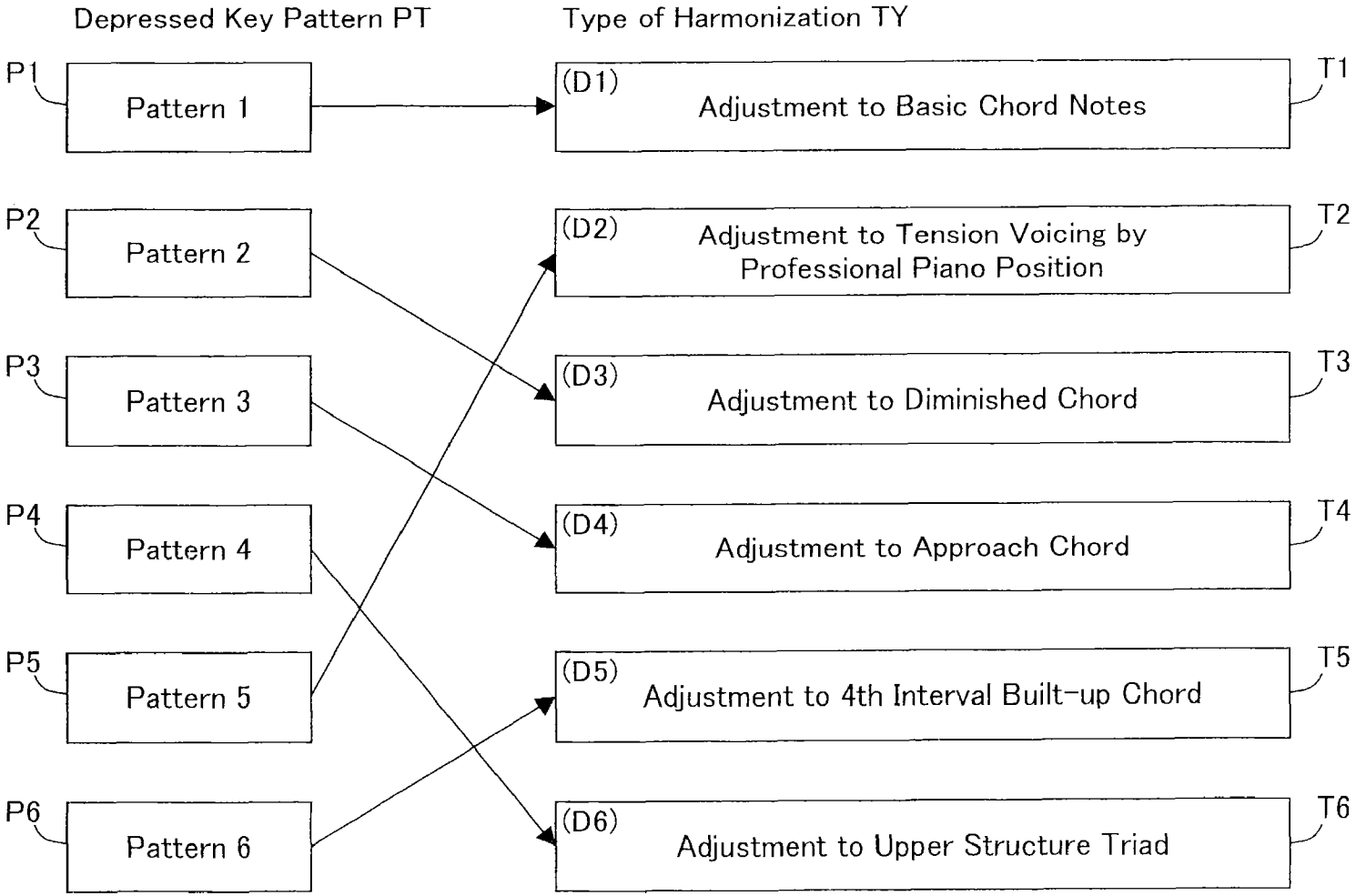

*Fig. 7a* Input by Key Depression (Plural Input Notes Nip)
(Depressed Key Pattern PT = P1)
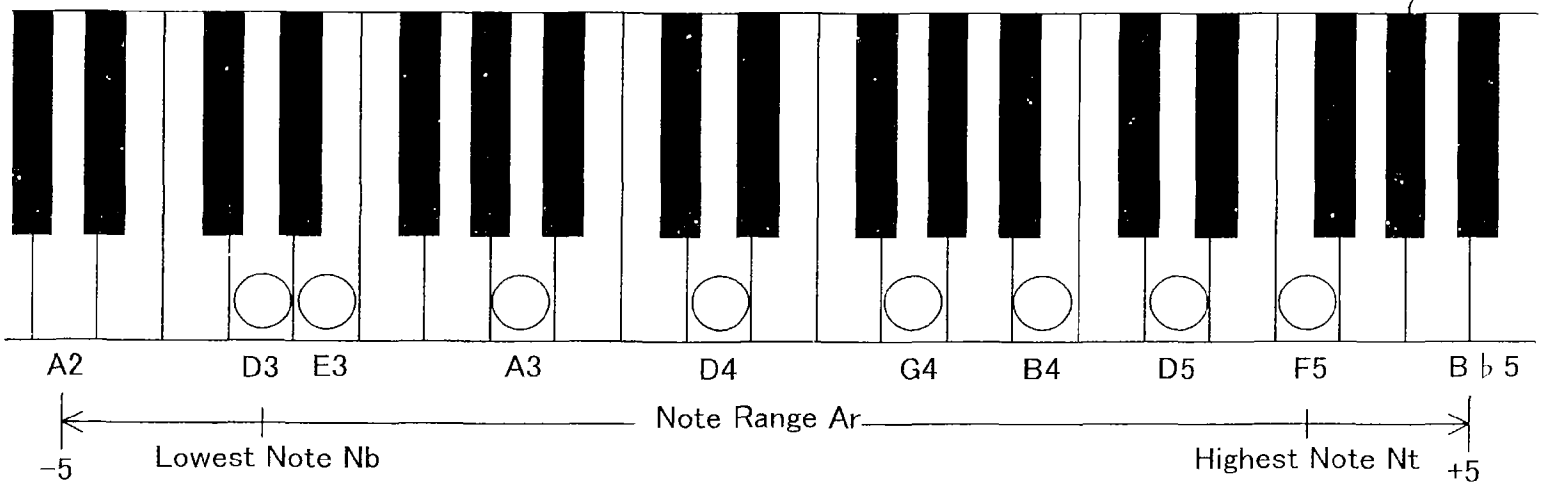
*Fig. 7b* Notes in Adjustment Table (For C Major 7th Chord)
(Adjustment Table Ta to Chord Notes Is Spread over Note Range Ar)
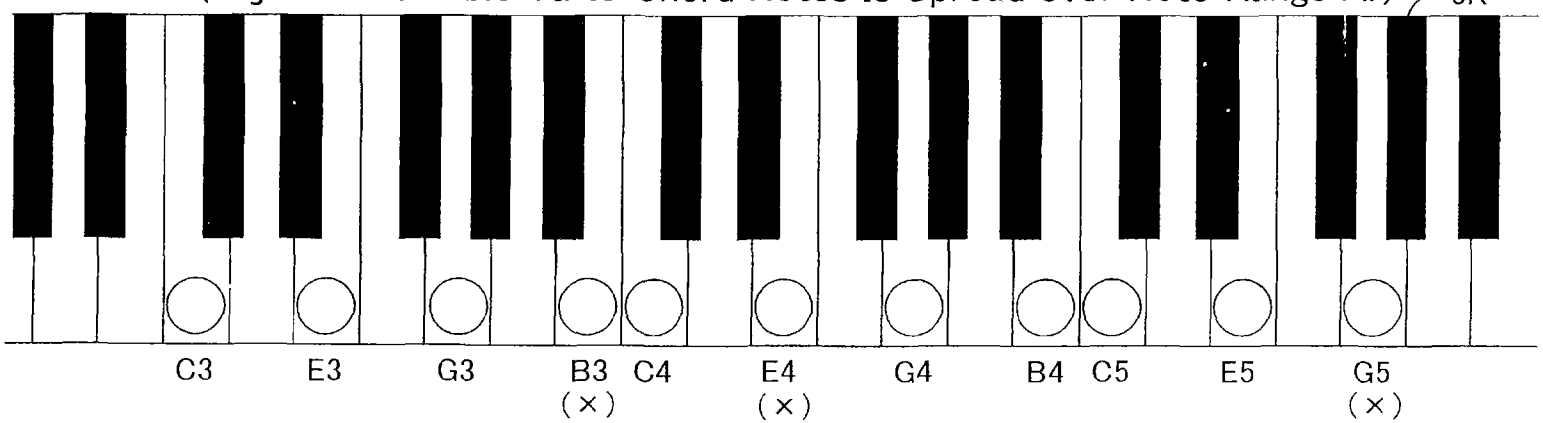

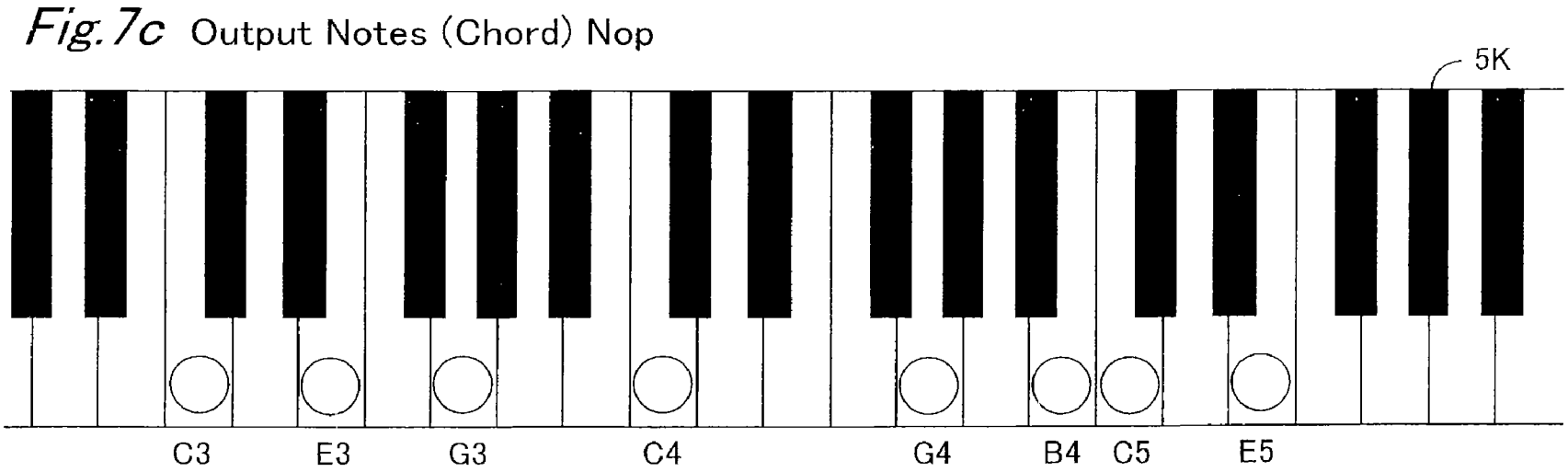
*Fig. 7c* Output Notes (Chord) Nop

ELECTRONIC KEYBOARD MUSICAL INSTRUMENT FOR ASSISTING IN IMPROVISATION

TECHNICAL FIELD

The present invention relates to an electronic keyboard musical instrument and a computer program for assisting in improvisation, and more particularly to such an instrument and a program for assisting a player of the instrument in performing an improvisation with a polyphonic music progression by manipulating plural keys on the keyboard, wherein the instrument or the program adjusts a note of an erroneously depressed key, if any, to the note of a correct key to be depressed to conduct voicing in acceptable harmonization in view of musical grammar. Thus a player can perform a seemingly highly skilled improvisation even with unskilled manipulation on the keyboard.

BACKGROUND INFORMATION

Improvisation is a kind of musical performance, which is a combination of creating music and playing music simultaneously, and the real pleasure resides in expressing the player's own intention and emotion widely and freely. However, playing an improvisation will require a high level of musical knowledge and music playing skill, and will be a very hard performance for a player (user) having insufficient knowledge and little experience. It would, therefore, be helpful for those players, if some assisting technology should be developed and presented with which even an unskilled player could express his/her own intention and emotion to his/her content. An example of an apparatus for assisting in performing an improvisation in the art is shown in unexamined Japanese patent publication No. 2004-206073, in which the notes input from the key depression by the player are changed to the chord notes or the tension notes in real time to be output as tones by means of the tone generator. With such an apparatus, however, the produced notes are limited within the harmonization voicing by the basic chord notes and the tension notes, even if whichever keys the player depresses. And accordingly, a highly skilled performance suited for an improvisation would not be realized.

SUMMARY OF THE INVENTION

In view of the foregoing circumstances, therefore, it is a primary object of the present invention to provide an electronic keyboard musical instrument incorporating an improvisation assisting system capable of realizing a seemingly skilled performance of improvisation based on uncomplicated manipulation of the keyboard by a player with little musical knowledge and playing experience.

According to the present invention, the object is accomplished by providing an electronic keyboard musical instrument for assisting in improvisation comprising: a musical keyboard including white keys and black keys; an input note acquiring device for acquiring input note data representing notes input by a number of keys simultaneously depressed in the keyboard; a key pattern judging device, provided with a number of predetermined patterns of depressed keys, for judging which of the patterns the simultaneously depressed keys exhibit based on the acquired input note data; a harmonization type determining device, provided with a number of types of harmonization, for determining a type of harmonization from among the provided types of harmonization for the notes of the depressed keys based on the judged patterns of the depressed keys, each type of harmonization determining chord notes for the type of harmonization; and a note adjusting device for adjusting the input note data to chord data which represent chord notes as determined by the type of harmonization. The same function can be realized by a computer program for a computer coupled to a musical keyboard including white keys and black keys and functioning as an electronic keyboard musical instrument, the computer program containing instructions for: acquiring input note data representing notes input by a number of keys simultaneously depressed in the keyboard; providing a number of predetermined patterns of depressed keys; judging which of the provided patterns the simultaneously depressed keys exhibit based on the acquired input note data; providing a number of types of harmonization; determining a type of harmonization from among the provided types of harmonization for the notes of the depressed keys based on the judged patterns of the depressed keys, each type of harmonization determining chord notes for the type of harmonization; and adjusting the input note data to chord data which represent chord notes as determined by the type of harmonization. Thus, even a player with little musical knowledge and playing experience can perform a seemingly skilled improvisation based on uncomplicated manipulation of the keyboard to depress the keys in a depression pattern, thereby selecting the corresponding one from among plural ways of more sophisticated harmonization.

In an aspect of the present invention, the electronic keyboard musical instrument may further comprise: a chord progression providing device for providing chord progression data; a plurality of chord adjustment tables provided respectively corresponding to the types of harmonization, each adjustment table for indicating adjustment of input notes inadequate to constitute a chord to adequate notes to constitute a chord for the corresponding type of harmonization in view of musical grammar; and an adjustment table designating device for designating an adjustment table to be applied to the determined type of harmonization, wherein the note adjusting device prepares an adjustment table to be used in adjusting the input notes to match the chord data in the chord progression data based on the determined type of harmonization. Thus, uncomplicated manipulation of the keyboard in a key depression pattern will present harmonization which fits the chord provided by the running chord progression.

In another aspect of the present invention, the key pattern judging device may judge, when the depressed keys include two highest keys which are apart from each other by an interval larger than a predetermined amount, the pattern of the simultaneously depressed keys by excluding the higher of the two. Further, the relationship between the patterns of the depressed keys and the types of harmonization to be used in the harmonization type determining device can be set by a user of the instrument. Still further, the patterns of the depressed keys may be featured by the arrangement of the white keys and the black keys among the depressed keys in general. Still further, the patterns of the depressed keys may be featured by the location of the black keys among the depressed keys. Still further, the patterns of the depressed keys are featured by the number of black keys among the depressed keys.

According to the present invention, the object is further accomplished by providing an electronic keyboard musical instrument for assisting in improvisation comprising: a musical keyboard including white keys and black keys; a chord progression providing device for providing chord progression data; an input note acquiring device for acquiring input note data representing notes input by a number of keys simultaneously depressed in the keyboard; a key pattern judging device, provided with a number of predetermined patterns of depressed keys, for judging which of the patterns the simultaneously depressed keys exhibit based on the acquired input note data; a chord change table for changing the chord progression data to represent another chord which matches the judged depressed key pattern; and a note adjusting device for adjusting the input note data to chord data which represent chord notes as represented by the changed chord progression data. The same function can be realized by a computer program for a computer coupled to a musical keyboard including white keys and black keys and functioning as an electronic keyboard musical instrument, the computer program containing instructions for: providing chord progression data; acquiring input note data representing notes input by a number of keys simultaneously depressed in the keyboard; providing a number of predetermined patterns of depressed keys; judging which of the patterns the simultaneously depressed keys exhibit based on the acquired input note data; changing the chord progression data to represent another chord which matches the judged depressed key pattern; and adjusting the input note data to chord data which represent chord notes as represented by the changed chord progression data. Thus, even a player with little musical knowledge and playing experience can realize harmonization using various sophisticated chords based on uncomplicated manipulation of the keyboard to depress the keys in a depression pattern, in which a simple chord contained in the chord progression may be changed to a more sophisticated chord comprising a note other than the chord constituent notes of a basic chord.

In order to realize various harmonization for various expressions of musical performance, there are plural types of harmonization employed in the present invention. A simplest harmonization type is one that uses only chord constituent notes of a basic chord, and is to be employed when the depressed keys exhibit a simple pattern of arrangement in the keyboard. More complex harmonization types may be one that uses a tension note of a professional piano position, another one that uses a note to constitute a diminished chord, a further one that uses an approach note, a still further one that uses a note for a fourth interval built-up chord, and a still further one that uses a note to constitute an upper structured triad, for example. A harmonization type is determined in accordance with the categorized patterns which the depressed keys exhibit. Thus, depending on the pattern of the depressed keys, harmonization with various chord including complex chords can be realized.

In the electronic keyboard musical instrument of the present invention, the structural element devices can be structured either by means of hardware circuits or by a computer system performing the assigned functions according to the associated programs. For example, the input note acquiring device, the key pattern judging device, the harmonization determining device, the note adjusting device, the chord progression providing device, and the adjustment table designating device can be practiced using hardware circuits or using a computer system operated with the programs to perform the respective functions.

The invention and its various embodiments can now be better understood by turning to the following detailed description of the preferred embodiments which are presented as illustrated examples of the invention defined in the claims. It is expressly understood that the invention as is defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram showing the hardware configuration of an electronic keyboard musical instrument according to an embodiment of the present invention;

FIG. 2*a* is a chart showing the note names of the keys in a keyboard employed in an embodiment of the present invention;

FIG. 2*b* is a table showing the correspondence between the keyboard and the scale-characteristic notes from the viewpoint of harmonic voicing with respect to the scale of C major and the chord of C major seventh;

FIG. 3 is a functional block diagram showing the note data processing configuration according to an embodiment of the present invention;

FIG. 4 is a flow chart showing the chord note adjustment processing performed in an embodiment of the present invention;

FIG. 5*a* is a chart showing patterns of the depressed keys as categorized in terms of the arrangement in general of the white keys and the black keys to be employed in an embodiment of the present invention;

FIG. 5*b* is a chart showing patterns of the depressed keys as categorized in terms of the position of the black keys to be employed in an embodiment of the present invention;

FIG. 5*c* is a chart showing patterns of the depressed keys as categorized in terms of the number of black keys to be employed in an embodiment of the present invention;

FIG. 6 is a chart showing the types of harmonization to be employed in processing for the respective patterns of the depressed keys in an embodiment of the present invention;

FIG. 7*a* is a chart showing the notes input by the depressed keys and the note range used in the note data processing in an embodiment of the present invention;

FIG. 7*b* is a chart showing the notes in the adjustment table, as viewed on a keyboard, used in the note data processing in an embodiment of the present invention; and FIG. 7*c* is a chart showing the notes, as viewed on a keyboard, output after the note adjustment in the note data processing in an embodiment of the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Hardware Configuration of an Electronic Keyboard Musical Instrument

The present invention is an electronic keyboard musical instrument for assisting in improvisation by automatically adjusting inadequate notes as caused by a rough (or inadvertently erroneous) manipulation of the keyboard to adequate notes as viewed from musical grammar by judging the positional (or existence) pattern of the depressed keys and applying correct harmonization depending on the judged pattern.

FIG. 1 shows a block diagram illustrating the hardware configuration of an electronic keyboard musical instrument according to an embodiment of the present invention. The electronic musical instrument comprises a central processing unit (CPU) 1, a random access memory (RAM) 2, a read-only memory (ROM) 3, an external storage device 4, a music playing unit 5, a panel control unit 6, a display unit 7, a tone generator 8 and a communication interface 9, all of which are connected with each other by a system bus 10.

The CPU 1 functions as a data processing unit in association with the RAM 2 and the ROM 3, and conducts various musical data processing including improvisation assist processing according to the dedicated and the associated software program, and also functions as a sequencer module (SQ) and a musical tone generating module (MP) in processing for assisting in improvisation. The RAM 2 is used as work areas for temporarily store various data necessary for the processing, for example the key depression data based on the user's music playing operation and the chord data based on the chord progression data. The ROM 3 stores beforehand various control programs for conducting musical data processing including the improvisation assist processing, and also stores various musical rules, chord progression data, key depression pattern data, chord constituent note adjustment table and so forth in order to execute the above-mentioned musical data processing.

The external storage device 4 may include storage media such as a hard disk (HD), a compact disk read-only memory (CD-ROM), a flexible disk (FD), a magneto-optical (MO) disk, a digital versatile disk (DVD), a semiconductor memory, which can store the improvisation assisting program, the musical rules, the chord progression data, the key depression pattern data, the chord constituent note adjustment table as mentioned above to be used in the system of the present invention.

The music playing unit 5 comprises music playing devices including a keyboard 5K and foot pedals and a play detection circuit, and processes the music playing signals such as key depression signals input based on the user' playing operation with the music playing devices to supply music playing data including key depression data to the data processing unit.

The panel control unit 6 includes panel controls such as various keys and switches on a control panel and a control input detecting circuit, and detects the contents of various settings and controls by means of the control input detecting circuit based on the user's operation of the panel controls, and sends the detected content data to the data processing unit. The panel controls are used, for example, for setting operation modes of the electronic keyboard musical instrument, and under the improvisation assist mode, for setting the rules to be applied in improvisation, for designating the chord progression data and the key depression pattern data, for allocating the chord constituent note adjustment table to the key depression patterns, and so forth.

The display unit 7 controls the displayed contents of the display device 11 (such as an LCD) and lighting conditions of various indicator lamps (not shown) which are connected to the display unit 7 according to the instruction signals from the data processing unit, and will visually assist the user in manipulating the music playing unit 5 and the panel control unit 6. For example, under the improvisation assist mode, the display device 11 may display the key information (the designated key note Ky) and the chord information in the currently supplied chord progression data. The tone generator 8 includes a tone generating circuit and an effect imparting DSP (digital signal processor) and generates musical tone signals corresponding to the music playing note data created through the improvisation assist processing in the data processing unit. The sound system 12 connected to the tone generator 8 include a D/A convertor, an amplifier and a loudspeaker, and emits audible musical sounds based on the tone signals from the tone generator 8.

The communication interface 9 includes various interface circuits connecting various external apparatuses 13 (e.g. other MIDI apparatuses, personal computers, servers, etc.) having functions of processing musical data, and receives various musical data including chord progression data and control programs from the external apparatuses 13. The electronic keyboard musical instrument of the present invention may not necessarily be an "electronic musical instrument" which is a type of data processing apparatus dedicated to musical data processing, but may be configured by a personal computer (PC) provided with or connected to a keyboard and a tone generator circuit plus an application software (computer program).

The electronic keyboard musical instrument, under the improvisation assist mode, adjusts the input note or notes using a chord progression data chain (CP) selectively designated out of the ROM 3 or the external storage 4 to create a chord progression data chain constituted by an array of plural pieces chord data (Cd) described in time series. Each piece of chord data is described by a diatonic chord of a triad (three-note chord) and a seventh chord (four-note chord), in the following example, and is identified by the root (e.g. C, D, E, and so forth) and the chord type (e.g. M (major), m (minor), M7 (major seventh), and so forth) in combination. A chord progression data chain contains key note data Ky to indicate the designated key (tonality). The keyboard chart of FIG. 2*a* shows the note names of the keys in a keyboard, and the table of FIG. 2*b* shows the correspondence between the keyboard and the scale-characteristic notes from the viewpoint of harmonic voicing with respect to the scale of C major and the chord of C major seventh, as employed in an embodiment of the present invention.

For example, where the designated key Ky is CM (the C major scale) and the chord (Cd) is CM7 (the C major seventh chord), the tonic note (key note) is C4 (the note number=60), and the notes C4, E4, G4 and B4 indicated by the symbol Cn in the table are called chord notes (chord constituent notes), the notes D4, A4, D5 (9th) and A5 (13th) indicated by Tn are called tension notes, the note F4 indicated by An is called an avoid note, and the non-diatonic notes C#4 (=Db4), Eb4 (=D#4), F#4 (=Gb4), Ab4 (=G#4) and Bb4 (=A#4) indicated by Cr are called chromatic notes. In addition, the notes Eb4, F#4 and Bb4 indicated by Bn at a minor third interval, a diminished fifth interval and a minor seventh interval, respectively, from the tonic note C4 are called blue notes.

It should be understood that the note names are herein expressed in a widely prevailing engineering method taking the middle C (the note number in the MIDI protocol is "60") as "C4," using capital letters of alphabet plus octave numbers. It should further be understood that the musical flat symbol (♭) is represented by a small letter of alphabet character "b" for the sake of typing convenience, as long as it is so understandable from the context. The musical sharp symbol (♯) is represented by the type font of "#" for the sake of typing convenience also.

Outline of Improvisation Assisting

The improvisation assist system in the electronic keyboard musical instrument according to an embodiment of the present invention is to make adjustments of the notes input according to the key depressions on the keyboard by the user (player), and thereby to provide in real time music playing note data representing notes which are musically acceptable and which reflect the playing intention of the player, using an improvisation assist processing program. This will release the player from concentrating on the functional arrangement (positioning) of the notes in view of harmonization so that the player can devote himself/herself to expressing instantaneous playing intentions in succession and can enjoy the real pleasure of improvisation freely and easily expressing his/her own playing intentions.

More specifically, the player will only have to manipulate the keyboard 5K roughly to input music playing notes without paying careful attention to the functional arrangement of the harmonizing notes, and paying attention to the key depression timing, the number and the positional pattern of simultaneously depressed white keys and black keys, the rough pitches and the motion of the notes, the intensities of the notes, etc. The assist system detects the number of simultaneously depressed keys and judges whether the player is playing a phrase (i.e. melody fraction) or a chord, and outputs in real time, for each manipulation by the player, music playing note data of the notes which fit the intended expression of the player. When a phrase playing is judged, the output notes No will be adjusted so that the direction of the pitch motion of the input notes Ni and that of the output notes No are the same and that the pitch difference between the input note Ni and the output note No is minimal within the allowance of musical grammar. It should be understood that the term "adjust" and "adjustment" means "to change where necessary, and not change where unnecessary" where the context so permits.

The general rules (A) to match the player's playing intentions are, for example, the following (A1)-(A4):

(A1) The processing is conducted real time only in response to each input note Ni to substantially keep the tone producing time point at the actual key depression by the player.

(A2) The velocity (key depression intensity) of the input note Ni is used for the velocity of the output note No to substantially keep the key depression strength.

(A3) The input note Ni is adjusted (changed where necessary, unchanged where unnecessary) to No which is as close in pitch as possible to the input note Ni to substantially keep the intended pitch motion.

(A4) The number of input notes Ni is reflected to the number of output notes No as close as possible to substantially keep the number of notes to be simultaneously played.

In addition, the speed (tempo) of the music progression may be controlled by the operation of a foot pedal in the music playing unit 5 so that the tempo of the musical performance (playback tempo of the chord progression data) should be controlled according to the foot beat.

Further, among the general rules (A), the system employs the following rule (A5):

(A5) Whether the key depression is the depression of a single key (monophonic depression) or the depression of a plurality of keys (polyphonic depression) is judged to determine a phrase playing or a chord playing.

In this instance, more specifically, the judgment whether the key depression is for a phrase playing or for a chord playing is made depending on whether a single note is input or plural notes are input by the player's key depression at a time. For example, the simultaneousness is judged on the criterion of 30 ms (milliseconds) in which the system examines whether a note comes within 30 ms after the preceding note to judge whether the player has intended a phrase playing or a chord playing. In addition, considering the possibility that the player is intending a concurrent playing of a phrase and a chord in combination, when a plurality of notes are simultaneously input, if the highest two notes among others are apart from each other by a musical interval more than a predetermined amount (e.g. two octaves), the higher of the two (i.e. the highest of all) is to be considered a phrase note and the others (including the lower of the two) are to be considered chord notes.

When a single note is input, that is, the number of simultaneously depressed keys is one (1), the system conducts a note adjustment for the phrase note and generates an output note by adjusting the input note, where unallowable, to an allowable note from a grammatical point of view. The general rule (B) for the phrase note adjustment is, in this instance, a same-direction-motion rule that the direction of the motion of the output phrase (consecutive notes) is made the same as that of the input phrase to follow the player's intention. According to the same-direction rule, more specifically, the direction of motion of each played note from the preceding played note is memorized, whether the adjusted note gives a melodic motion of the same direction is examined, and if the examination tells that the adjusted note gives a motion in the same direction, the adjusted note is output as it is, and if the examination tells that the adjusted note does not give a motion in the same direction, the adjusted note is subject to further adjustment to be an allowable note giving a motion in the same direction. Thus, the intended direction of the phrase motion is maintained.

The system is further provided with monophonic note adjustment rules (C) including the following rules (C1)-(C5) to enhance the versatility in a phrase performance. The player manipulates a predetermined control in the panel control unit 6 before or during the musical performance to select any desired one in the rules (C1)-(C5) stored in the ROM 3 or the external storage 4. By selecting the rules (C1)-(C5), the player can realize various types of phrase performance. The rules are:

(C1) Adjustment within the diatonic scale.

(C2) Adjustment within the blues scale #1.

(C3) Adjustment within the blues scale #2.

(C4) Hybrid adjustment using the chord notes and the blue notes.

(C5) Adjustment also using the avoid notes and the chromatic notes.

The details of each adjustment rule will be described herein later.

When a plurality of notes are input, that is, the number of simultaneously depressed keys is two (2) or more, the system conducts note adjustments for the chord notes and generates output notes by adjusting the input notes, where unallowable, to chord notes corresponding to the distribution condition of the plural input notes. As the general rule for the chord note adjustment, the lowest-note precedence rule (D0) is employed, when the lowest note among the plurality of input notes is lower than a predetermined note pitch.

(D0) Lowest-note precedence rule: The bass note (root note) of the chord to be generated should be a note having the note pitch of the chord bass which pitch is the same as or closest to the lowest note of the input notes. This rule will enhance stableness of the generated chord for the chord playing intended by the player.

In order to realize a plurality of chord adjustment functions, the system of the present invention stores, in the ROM 3 or the external storage 4, a plurality of patterns PT, a plurality of chord adjustment rules (D1-D6 to be described later), a chord constituent note adjustment table TL including a plurality of adjustment tables (Ta-Tf), etc. The player can determine which of the patterns and which of the adjustment tables to use. In other words, the player can designate the pattern feature group PT, and allot the depressed key patterns (P1-P6) in the designated pattern feature group PT to the chord adjustment rules (D1-D6) before starting a performance. When the player depresses a plurality of keys simultaneously, the system looks up the patterns in the pattern group PT and judges which of the patterns (P1-P6) the distribution of the input notes Ni (i.e. the depressed keys) exhibit, and generate chord playing notes based on the chord adjustment rule (D1-D6) described in the adjustment table (Ta-Tf) which corresponds to the judged pattern (P1-P6), thereby presenting a musical performance using various types of chords. The key depression patterns P1-P6 are to be allotted to the chord adjustment rules D1-D6 preferably by the player, or may be fixedly set.

FIG. 3 shows a functional block diagram illustrating the note data processing configuration for assisting in improvisation according to an embodiment of the present invention. As the electronic keyboard musical instrument runs into the improvisation assist mode according to the manipulation of the mode setting control switch in the panel control unit, the system operates in accordance with the improvisation assist processing program and organizes (prepares) a performance note generating module MP and a sequencer module SQ in the data processing unit. In the improvisation assist mode, the initial setting takes place first. For example, the player manipulates the chord progression designating switch, the monophonic rule selecting switch, the pattern and chord adjustment rule allotting switch, and other controls to designate a desired chord progression date CP to be supplied during the playing, select the monophonic note adjustment rule, and allot the depressed key patterns P1-P6 to the corresponding chord adjustment rules D1-D6 for the respective harmonization types.

These setting can be arbitrarily changed during playing.

As the player instructs the playback of the chord progression by manipulating the control in the panel control unit 6, the sequencer module SQ plays back the designated chord progression data CP and supplies the chord data Cd and the keynote (tonality) data Ky to the performance note generating module MP. The player can advance or stop the supply of the chord progression data Cd by manipulating the progression control switch provided in the music playing unit 5. As the keyboard 5K is manipulated for playing music, the music playing unit 5 input note data Ni based on the key depression to a function block (submodule) M1 of the performance note generating module MP for judging the distribution of the depressed keys (chords).

The function block M1 for judging the distribution of the depressed keys (chords) examines the distribution condition of the simultaneously depressed keys from the input music playing note data Ni and judges whether the input music playing note data Ni is of a single note input intending a phrase performance or of plural note inputs intending a chord performance, and sends the input single note playing data Nis representing a phrase note to a function block (submodule) M2 for adjusting to a phrase note and the input plural note playing data Nip representing a chord notes to a function block (submodule) M3 for chord note adjustment processing. In the case where three or more notes are input and the highest two of them are apart from each other by more than a predetermined musical interval (e.g. two octaves), the highest input note is judged to be a phrase note Nis and the second highest and the other notes are judged to be chord notes Nip.

The function block M2 for adjusting to a phrase note conducts the note adjustment (1)-(5) of the input monophonic music playing note data according to the selected monophonic note adjustment rule (C1)-(C5) and generates an output desirable phrase note Nos representing a desirable note pitch for a phrase note. The operations under the individual monophonic note adjustment rules (C1)-(C5) are described hereunder.

(C1) Adjustment Within the Diatonic Scale.

When the rule (C1) for the adjustment within the diatonic scale is selected, any monophonic key depression by the player will result in the generation of a note on the diatonic scale and accordingly a phrase will be played using only the diatonic scale notes of the musical scale in the designated key (tonality) Ky. For example, where the designated key Ky is GM (G major), the input notes C4, D4, E4, F4, G4, A4 and B4 will be adjusted to output notes C4, D4, E4, F#4, G4, A4 and B4, respectively, on the GM scale.

(C2) Adjustment Within the Blues Scale #1.

When the rule (C2) for the adjustment within the blues scale #1 is selected, any monophonic key depression by the player will result in the generation of a note on the blues scale (including blue notes) and accordingly a phrase will be played in the blues feeling with the player paying no particular attention. For example, where the designated key Ky is CM (C major), the input notes C, D, E, F, G, A and B will be adjusted to output notes C, D, Eb, F, Gb, A, Bb on the CM blues scale.

(C3) Adjustment Within the Blues Scale #2.

When the rule (C3) for the adjustment within the blues scale #2 is selected, any monophonic white key depression by the player will result in the generation of a note on the diatonic major scale and any monophonic black key depression will result in the generation of a note on the blues scale (e.g. Eb, F# (=Gb) and Bb as shown in FIG. 2*b*, in the case of the CM with the tonic C). For example, where the designated key Ky is CM (C major), the input white key notes C through B will be adjusted to output notes C through B on the C major scale which notes are respectively nearest to the input notes, while the input black key note C#, Eb, F#, Ab, and Bb will be adjusted to output notes Eb, Eb, F# (=Gb), F# (=Gb) or Bb, and Bb, respectively.

(C4) Hybrid Adjustment Using the Chord Notes and the Blue Notes.

When the rule (C4) for the hybrid adjustment using the chord notes and the blue notes is selected, any monophonic white key depression will result in the generation of a chord constituent note and any monophonic block key depression will result in the generation of a note on the blue scale, so that the player can play a phrase using notes other than the basic blue notes. Namely, the input black key notes are adjusted to notes on the blues scale in the designated key Ky, each adjusted note being nearest to each input black key note, and the input white key notes are adjusted to the notes constituting a chord determined by the chord data Cd and the keynote data Ky from the sequencer module SQ.

For example, where the tonality key is designated as CM (C major) by the keynote data Ky contained in the chord progression data CP, the input black key notes C#, Eb, F#, Ab, and Bb are adjusted to blue notes Eb, Eb, F# (=Gb), F# (=Gb) or Bb, and Bb, respectively, each of which is the nearest to each of the input notes, as in the case of (C3) mentioned above. The input white key notes C through B, on the other hand, are adjusted to the respectively nearest notes constituting a chord in the designated key Ky, namely the CM key. Where the chord data Cd in the chord progression data CP designates the chord of CM7 (C major seventh) whose chord notes are C, E, G and B, the input white key notes C, D, E, F, G, A, and B are adjusted to the nearest chord notes C, C or E, E, E, G, G or B, and B, respectively.

(C5) Adjustment Also Using the Avoid Notes and the Chromatic Notes.

When the rule (C5) for the adjustment also using the avoid notes and the chromatic notes is selected, monophonic white key depressions will cause the generation of the chord notes and the tension note, and monophonic black key depressions will cause the generation of the avoid notes and the chromatic notes, so that the player can intentionally deviate an output note from the designated scale at occasionally at desirable time points. More specifically, the input white key notes are adjusted to the chord notes and the tension notes determined by the chord data Cd and the keynote data Ky, while the input black key notes are adjusted to the avoid notes and the chromatic notes which are deviated from the scale of the designated key Ky.

For example, where the tonality key is designated as CM, the input white key notes C4, D4, E4, F4, G4, A4, and B4 are adjusted to the nearest chord constituent notes and the tension notes in the designated key of CM, namely, to C4, D4 or D5, E4, E4, G4, A4 or A5, and B4. The input black key notes C#4, Eb4, Ab4 and Bb4 which are not adjacent to the avoid note (F) are adjusted to the corresponding chromatic notes C#4, Eb4, Ab4 and Bb4 (this adjustment happens to make no change) of the designated key CM, while the input black key note F#4 which is adjacent or identical to the avoid note is adjusted to the avoid note F#4 (this adjustment again happens to make no change) of the designated key CM.

The function block M3 for chord note adjustment processing first conducts a preprocessing of the input plural note playing data Nip for enhancing stableness of the chord before a function block M3*a* in the chord note adjustment processing block M3 determines the note range Ar of the note adjustment tables. Then a function block M3*b* examines the distribution condition of the depressed keys of the input plural note playing data Nip, compares with the depressed key patterns P1-P6 in the designated pattern feature group PT and judges which of the depressed key patterns P1-P6 the input plural note playing data Nip exhibits. A function block M3*c* then determines a type of harmonization TY which is allotted to the judged depressed key pattern P1-P6 from among the harmonization types T1-T6 for the respective chord adjustment rules D1-D6 prepared in the memory 3 and the storage 4. A function block M3*d* creates an adjustment table for the above determined note range Ar from a chord constituting note adjustment table TL containing sub-tables Ta-Tf corresponding to the chord adjustment rules D1-D6 and from the chord data Cd supplied from the sequencer module SQ, and conducts the adjustment to the chord notes according to the created adjustment table as voicing in the music playing. The chord constituting note adjustment table TL containing the sub-tables Ta-Tf may be called a "basic table of adjustment for voicing" or simply a "basic table." After adjustment to the chord notes to be output, a supplemental processing for enhancing stableness of the chord is conducted to output music playing chord data Nop representing the chord notes of desirable pitches in view of the range of the depressed keys in the keyboard.

A function block M4 for outputting the adjusted note(s) combines the output desirable phrase note Nos from the function block M2 for adjusting to phrase note and the output desirable chord notes Nop from the function block M3 for chord note adjustment processing, and outputs the combined outputs as output note(s) No to the tone generator 8, which in turn generates tone signals based on the output note(s) No.

As will be understood from the description above, with the improvisation assisting system of the electronic keyboard musical instrument according to the present invention, when the player depresses a plurality of keys in the keyboard 5K having plural white keys and plural black keys (as judged in M1), the depressed key pattern which corresponds to the distribution condition of the manipulated white keys and black keys is judged (in M3*b*) from among the prepared depressed key patterns P1-P6 based on the plural input notes Nip of the simultaneous manipulation of plural keys, the type of harmonization to be employed is determined (in M3*c*) corresponding to the judged depressed key pattern (one of P1-P6) from among the prepared plural types T1-T6 of harmonization respectively under the prepared harmonization rules D1-D6. The processing by the determined type of harmonization is then conducted to adjust the plural input notes Nip to desirable chord notes Nop (in M3*d*). The harmonization can be conducted by the processing under the rule (D1) for producing voicing notes including only basic chord constituent notes, and also by the processing under the rule (D2-D6) for producing voicing notes including notes other than the basic chord constituent notes. Thus, the output chord notes (voicing notes, harmonization notes) Nop can be of only the basic chord constituent notes on the one hand, and can be of various kinds of other notes.

Details of Harmonization Note Adjustment

As described herein above, the improvisation assist system of the electronic keyboard musical instrument according to the present invention produces the music playing note data of the harmonization notes (output chord notes) Nop of the desirable pitches by the note adjustment processing of the input note data of the plural notes Nip at the function block M3 for chord note adjustment processing. FIG. 4 shows a flow chart illustrating the chord note adjustment processing performed in an embodiment of the present invention. FIGS. 5*a*, 5*b* and 5*c* show various patterns of the depressed keys, in three feature groups, as categorized with respect to the arrangement of the white keys and the black keys in an embodiment of the present invention. FIG. 6 shows the types of harmonization to be employed in processing for the respective patterns of the depressed keys in an embodiment of the present invention. FIGS. 7*a*, 7*b* and 7*c* describes the process of the note adjustment according to the embodiment of the present invention, depicting visually on a musical keyboard to show the changes from the input notes to the output notes.

In a step S1, the CPU 1 acquires a plurality of input notes Nip from the music playing unit 5 according to the manipulation of the keyboard 5K by the player. Next, a step S2 conducts a pre-processing for enhancing the stableness of the chord, when necessary. In the preprocessing, if the bottom (lowest) note Nb among the plural input notes Nip is below a predetermined threshold, for example below C3 (MIDI note number is 48), the bottom note Nb is taken as the note which is to be adjusted to a root note in a chord note adjusting step S6 (to be described herein later), which note is named an "exceptional bottom note" and is stored in the RAM 2.

A step S3 is to determine the note range Ar of the adjustment table. The note range of the adjustment table is the range of notes which the input notes are to be adjusted to. The note range Ar of the adjustment table to be used in the chord note adjusting step S6 is determined to make a limited correlation between the range of the input notes Nip and the range of the output chord notes Nop after adjustment, as the exact correspondence between the number of simultaneous input notes Nip and the number of output notes Nop might sometimes cause the generation of a note greatly deviated from the depressed keys and would not necessarily result in favorable harmonization. However, when the step S2 has found that there is an exceptional bottom note, the note range Ar is determined based on the input notes Nip excluding the exceptional bottom note.

The note range Ar is determined, as shown in FIG. 7*a*, by extending the input note range between the lowest (bottom) note Nb and the highest (top) note Nt downward with a certain amount of margin (e.g. five semitones) and upward with a certain amount of margin (e.g. five semitones), thereby defining the lower limit at the note which is lower than the bottom input note Nb by the downward margin and the upper limit at the note which is higher than the top input note Nt so that the adjusted notes should fall within this defined note range Ar. More specifically, where the margins are minus 5 semitones and plus 5 semitones, the note range Ar of the adjustment table is between the "bottom note Nb minus 5 semitones" and the "top note Nt plus 5 semitones." For example, where the bottom note Nb is D3 and the top note Nt is F5, D3 minus 5 semitones makes A2 and F5 plus 5 semitones makes Bb5, and accordingly the note range Ar of the chord adjustment table is between note A1 and note Bb5.

A step S4 judges which of the categorized patterns P1-P6 in the depressed key pattern feature group PT (which is designated by the player) the input notes exhibit. More specifically, when the player depresses a plurality of keys in the keyboard 5K simultaneously, the system examines, in the step S4, the distribution condition (in terms of the white/black distinction and the position of each depressed key) of the depressed keys from the input notes Nip in comparison with the categorized patterns P1-P6 in the player-designated pattern feature group PT, and judges which of the patterns the depressed keys exhibit.

Where the pattern feature group PT of FIG. 5*a* is designated by the player, the step S4 examines the white/black distinction of each of the simultaneously depressed keys and categorizes the patterns from the viewpoint of white key existence and black key existence in general. The categorized patterns in this pattern feature group PT can be termed "white/black patterns." This pattern feature group PT may include eight kinds of patterns P1-P8, in which patterns P7 and P8 are occasional patterns to be used when the patterns P1-P6 are not applicable.

The patterns PT in this feature group are categorized into eight patterns as follows.

(a) Pattern 1 (P1) is an "all white" pattern in which all the depressed keys are white keys.

(b) Pattern 2 (P2) is an "all black" pattern in which all the depressed keys are black keys.

(c) Pattern 3 (P3) is a "left white and right black" pattern in which all the keys at the left of a certain point are white keys and all the keys at the right of the certain point are black keys.

(d) Pattern 4 (P4) is a "left black and right white" pattern in which all the keys at the left of a certain point are black keys and all the keys at the right of the certain point are white keys.

(e) Pattern 5 (P5) is a "both ends white" pattern in which both the left end key and the right end key are white keys, and the keys in between can be either all black keys or mixture of white and black keys.

(f) Pattern 6 (P6) is a "both ends black" pattern in which both the left end key and the right end key are black keys, and the keys in between can be either all white keys or a mixture of white and black keys.

(g) Pattern 7 (P7) is a "left end white and right end black" pattern in which the left end key is a white key and the right end key is a black key, and the keys in between are a mixture of white and black keys.

(h) Pattern 8 (P8) is a "left end black and right end white" pattern in which the left end key is a black key and the right end key is a white key, and the keys in between are a mixture of white and black keys.

The patterns P1-P4 will happen where two or more keys are depressed simultaneously. The patterns P5-P6 will happen where three or more keys are depressed simultaneously. The patterns P7-P8 will happen where four or more keys are depressed simultaneously.

For example, when the player depresses two keys (i.e. the number of simultaneously depressed keys is two), the depressed key pattern will be one of (a) through (d), i.e. patterns P1, P2, P3 and P4. When the player depresses three keys (i.e. the number of simultaneously depressed keys is three), the depressed pattern will be one of (a) through (f), i.e. patterns P1-P6. When the player depresses four or more keys (i.e. the number of simultaneously depressed keys is four or more), the depressed pattern will be one of (a) through (h), i.e. patterns P1-P8.

Where the pattern feature group PT of FIG. 5*b* is designated by the player, the step S4 examines the note name or names of the black key or keys among the simultaneously depressed keys and categorizes the patterns from the view point of the position (note name) of the black key as picked up according to a predetermined order of priority, for example, the highest (i.e. rightmost) black key among the simultaneously depressed keys. The black key to be checked in the case where there are two or more black keys in the simultaneously depressed keys may be predetermined otherwise than as the highest black key, namely, for example, as the lowest key or else. The categorized patterns in this pattern feature group PT can be termed "black position patterns."

This pattern feature group PT includes six kinds of patterns P1-P6 as follows.

(a) Pattern 1 (P1) is a "no black" pattern in which all the depressed keys are white keys.

(b) Pattern 2 (P2) is a "black-is-C#" pattern in which the highest (as an example) depressed key is a C# key.

(c) Pattern 3 (P3) is a "black-is-D#" pattern in which the highest (as an example) depressed key is a D# key.

(d) Pattern 4 (P4) is a "black-is-F#" pattern in which the highest (as an example) depressed key is an F# key.

(e) Pattern 5 (P5) is a "black-is-G#" pattern in which the highest (as an example) depressed key is a G# key.

(f) Pattern 6 (P6) is a "black-is-A#" pattern in which the highest (as an example) depressed key is an A# key.

The pattern P1 will happen where all the simultaneously depressed keys are white keys. The pattern P2 will happen where the highest depressed key (indicated by a symbol of asterisk *) is a C# key. The pattern P3 will happen where the highest depressed key is a D# key. The pattern P4 will happen where the highest depressed key is an F# key. The pattern P5 will happen where the highest depressed key is a G# key. The pattern P6 will happen where the highest depressed key is an A# key. When the player depresses a plurality of keys simultaneously, the system examines the positions of the depressed black keys and judges which of the patterns P1-P6 the depressed keys exhibit.

Where the pattern feature group PT of FIG. 5*c* is designated by the player, the step S4 examines the number of simultaneously depressed black keys. The categorized patterns in this pattern feature group PT can be termed "number-of-blacks patterns."

This pattern feature group PT includes six kinds of patterns P1-P6 as follows.

(a) Pattern 1 (P1) is a "zero black" pattern in which there is no black key in the depressed keys.

(b) Pattern 2 (P2) is a "one black" pattern in which there is one black key in the depressed keys.

(c) Pattern 3 (P3) is a "two blacks" pattern in which there are two black keys in the depressed keys.

(d) Pattern 4 (P4) is a "three blacks" pattern in which there are three black keys in the depressed keys.

(e) Pattern 5 (P5) is a "four blacks" pattern in which there are four black keys in the depressed keys.

(f) Pattern 6 (P6) is a "five blacks" pattern in which there are five black keys in the depressed keys.

The pattern P1, P2 and P3 will happen where two or more keys are depressed simultaneously. The pattern P4 will happen where three or more keys are depressed simultaneously. The pattern P5 will happen where four or more keys are depressed simultaneously. The pattern P6 will happen where five or more keys are depressed simultaneously. When the player depresses a plurality of keys simultaneously, the system examines the number of depressed black keys and judges which of the patterns P1-P6 the depressed keys exhibit.

After the step S4 judges the depressed key pattern of the input notes Nip, a step S5 determines the type of harmonization for the input notes Nip according to the allotment of the respective patterns to the respective types of harmonization to be employed in processing using the rules to be applied in harmonization. More specifically, with the embodiment of the present invention, the player can set the allotment (correspondence) of the depressed key patterns P1-P6 to the harmonization types T1-T6, for example, as shown by arrow lines in FIG. 6 manipulating a pattern-to-table allotment switch in the panel control unit 6 before starting the improvisation assist processing. For the convenience of players, a default allotment may preferably be preset in the electronic keyboard musical instrument and alterable by an allotment switch.

The types of harmonization TY include the following six types (1)-(6) for performing adjustment in different ways D1-D6, respectively, to realize not only the adjustment to basic chord notes but also the adjustment to other notes to use various voicing harmonies.

(1) Harmonization Type 1 is an adjustment D1 using basic chord notes.

(2) Harmonization Type 2 is an adjustment D2 using tension voicing by professional piano position.

(3) Harmonization Type 3 is an adjustment D3 using a diminished chord.

(4) Harmonization Type 4 is an adjustment D4 using an approach chord.

(5) Harmonization Type 5 is an adjustment D5 using a fourth interval built-up chord.

(6) Harmonization Type 6 is an adjustment D6 using an upper structure triad.

After the step S5 determines the type of harmonization (one of T1-T6) corresponding to the depressed key pattern (P1-P6) input by the player, a step S6 then conducts the adjustment (D1-D6) of the determined type (T1-T6) and adjust the input notes Nip to the chord notes which is fit for the determined type of harmonization using an adjustment table (Ta-Tf) in the chord constituting note adjustment table (voicing note adjusting table) TL as developed within the note range Ar, thereby generating the output chord notes.

The step S6 conducts adjustment to chord notes so that the output notes constitute a musically acceptable and significant chord, applying the following four basic rules D01-D04.

(D01) To keep a correlation between the acquired input notes Nip and the output chord notes after the adjustment.

(D02) To maintain the number of input notes Nip as much as possible.

(D03) To adjust an input note (Nip) to an output note (Nop) which is as close as possible to the input note (Nip).

(D04) To preferentially process an input note (Nip) with a higher velocity.

The rules for and the operations of the respective adjustments D1-D6 for proper voicing are as follows.

(D1) Type T1: Adjustment D1 using basic chord notes.

When the step S5 has determined the Type 1 adjustment, the step S6 selects an adjustment table Ta for the basic chord note adjustment from the chord constituent note adjustment table TL to conduct the adjustment to the basic chord notes. The adjustment table Ta provides chord constituent notes of the basic chord (regular chord) for the respective chord types, and describes the note names in the normalized tonality key, for example, the key of CM (C major). More specifically, with the root note of "C," for example, the chord type "M" (major) is constituted by the chord notes "C," "E" and "G," and the chord type "M7" (major seventh) is constituted by the chord notes "C," "E," "G" and "B."

When the adjustment to the basic chord notes is being conducted, the step S6 selects the chord constituting notes of the chord type as indicated by the chord data Cd included in the chord progression data Cp which is currently being supplied, shifts the selected chord constituting notes so that the normalized root note becomes the root note (key note) in the chord data Cd, and develops the shifted notes within the note range Ar determined at the step S3. The note range Ar defines the range in which the adjustment table Ta should be developed, and a set of the notes spread over this note range Ar can be called a denormalized adjustment table or an adjustment table for use. The chord note adjustment is conducted by applying the denormalized adjustment table to the input notes Nip through the method of (1)-(3) described below. Such a chord note adjustment will result in generating, for example, chord notes "C4," "G4," "C5," "E5," "G5" and "B5" in the case where the chord data Cd indicates CM7 (C major seventh chord).

(1) From the bottom note Nb of the input notes Nip upward, each of the input note Nip selects the closest note (in note pitch) from the denormalized adjustment table. If there are two closest notes (of the same pitch difference) in the table, the two will be temporarily selected as candidates. For example, the input note Nip is "D" and the denormalized adjustment table is " - - - , C, E, - - - ," the notes "C" and "E" from the table are selected for the input note "D."

(2) If the same note in the denormalized adjustment table is selected for two different (adjacent) input notes Nip, for example, in the case where the input notes "F" and "A" both select (focus on) "G" from the table " - - - , G, - - - ," the processing will go as follows.

(2a) If one of the two input notes selects two candidate notes, the note other than the focused note is selected for the input note with two candidates. For example, where the note "A" selects "G" and "B" from the table " - - - , G, B, - - - ," the above selected note "G" is allotted to the input note "F" and "B" of the two candidates is allotted to the input note "A."

(2b) If there is a note (named "M" herein) remaining unselected in the denormalized adjustment table below the lower (i.e. "F") of the two input notes "F" and "A," and also there is a note (named "N" herein) remaining unselected in the table above the higher (i.e. "A") of the two input notes "F" and "A," there are two ways of selection allotment "F to M and A to G" and "F to G and A to N." Of the two ways, one will be employed which presents a smaller sum of pitch differences in such an adjustment. In case the sums of pitch differences are the same, one of the two ways will be employed according to a predetermined preference of selection, for example the lower note "M" will be selected to result in the selection allotment "F to M and A to G."

(2c) If there is a note (named "M" herein) remaining unselected in the denormalized adjustment table below the lower (i.e. "F") of the two input notes "F" and "A," and there is no note remaining unselected in the table above the higher ("i.e. "A") of the two input notes "F" and "A," the adjustment table " - - - , M, G, - - - " will be allotted to the input notes "F" and "A" in the way of "F to M and A to G."

(2d) If there is no note remaining unselected in the denormalized adjustment table below the lower (i.e. "F") of the two input notes "F" and "A," and there is a note remaining unselected in the table above the higher ("i.e. "A") of the two input notes "F" and "A," the adjustment table " - - - , G, N, - - - " will be allotted to the input notes "F" and "A" in the way of "F to G and A to N."

(2e) If there is no note remaining unselected in the denormalized adjustment table below the lower (i.e. "F") of the two input notes "F" and "A," and there is no note remaining unselected in the table above the higher ("i.e. "A") of the two input notes "F" and "A," the adjustment table " - - - , G, - - - " will be allotted to one of the input notes "F" and "A" having a higher velocity value and no note will be allotted to the other of the input notes "F" and "A" having a lower velocity value.

(3) If the selection for the input notes has not been settled according to any of the above described processing methods, the selection will be made according to a simple rule, for example, to select the higher of the two candidates.

The note adjustment according to the present invention will be described with reference to FIGS. 7*a*, 7*b* and 7*c* hereunder. Where notes Nip indicated by hollow circles "○" are input as shown in FIG. 7*a* and the chord data Cd from the sequencer module SQ indicates the CM7 (C major seventh chord), the adjustment table to be used is as shown with hollow circles "○" in FIG. 7*b*, and output chord notes Nop will be as shown with hollow circles "○" in FIG. 7*c*. As the step S1 acquires the input notes Nip all of which are white key notes D3, E3, - - - , F5, the step S3 determines the note range Ar of the adjustment table to be A2 through Bb5, the step S4 judges that the depressed key pattern PT of the input notes Nip is the first pattern P1 (in any feature group), and the step S5 determines the type of harmonization TY to be the first type T1.

Then the step S6 reads out from the chord constituting note adjustment table TL a set of notes "C, E, G and B" which correspond to the chord type M7 (major seventh) in the selected adjustment table Ta, spreads (develop) the four notes within the note range Ar (i.e. between A2 and Bb5), and establishes an applicable adjustment table consisting of the notes C3, E3, - - - , G5 as shown in FIG. 7*b*. Then, according to the rules (1) and (2), the table notes are allotted to the input notes D3, E3, - - - , F5, respectively. As a result, the output notes Nop consisting of the notes C3, E3, - - - , G5 as shown in FIG. 7*c* are generated, with the table notes B3, E4 and G5 deleted from the notes to be output, as there are no corresponding input notes to be adjusted.

(D2) Type T2: Adjustment D2 using basic tension voicing by professional piano position.

When the step S5 has determined the Type 2 adjustment, the step S6 selects an adjustment tables Ta for the basic chord note adjustment and Tb for the tension voicing by professional piano position from the chord constituent note adjustment table TL to conduct the adjustment to the tension voicing by the professional piano position (this adjustment uses the tension notes as well as the basic chord notes). The system of the embodiment uses, as the tension voicing, a tension voicing method by professional piano position which will give the most natural harmony feeling among tension voicing. The tension voicing by professional piano position means in music a tension voicing in which a tension note NT is neighbored by a basic chord note by an interval of a major second or a minor second and the two notes are sandwiched by other two notes NL (from below) and NH (from above) each of which are apart from the two notes by intervals of a major third or longer. When the processing of the tension voicing by professional piano position is conducted, both the basic chord note adjustment table Ta and the tension note adjustment table Tb are used to output musically significant tension chord.

The tension note adjustment table Tb enumerates the tension notes in the normalized key (e.g. the key of CM) corresponding to the basic chord note adjustment table Ta. For example, the M7 tension notes corresponding to the basic chord notes "C," "E," "G" and "B" (for the root note of "C") of the M7 chord in the basic chord note adjustment table Ta are "D (2nd)," "A (6th)," "D (9th)" and "A (13th)." Accordingly, where the chord type represented by the chord data Cd is M7, the step S6 selects the M7 chord notes from the basic chord note adjustment table Ta and the M7 tension notes from the tension note adjustment table Tb, shifts the selected notes so that the normalized root note of M7 chord become the root note (key note) in the chord data Cd, and develop the shifted notes within the note range Ar determined at the step S3 to establish an adjustment table for the tension voicing by professional piano position, including a chord note adjustment table C and a tension note adjustment table T. The step S6 uses both of the tables C and T, and produces chord notes "C4," "B4," "D5," "E5" and "A5" (in the case of the chord data Cd indicates a CM7) of the tension voicing by professional piano position by adjusting the input notes Nip. The processing will be described in detail hereunder.

(1) In the tension voicing by professional piano position, the sandwiched tension note NT usually locates at five semitones or so below the top notes of a chord, and accordingly the step S6 calculates a note which is five semitones below the top note Nt of the input notes Nip and selects a tension note which is closest to the calculated note from the tension note adjustment table T. The selected note is then determined to be the tension note NT which will be sandwiched in the tension voicing by professional piano position.

(2) The step S6 selects, from the chord note adjustment table C, a chord note NC which can neighbor the above determined tension note NT with an interval of a major second or a minor second.

(3) With respect to the above determined tension note NT and chord note NC, the step S6 selects, from the chord note adjustment table C or the tension note adjustment table T, a lower note which locates below and closest to the lower of the two notes NT and NC and apart from the lower of the two notes NT and NC by an interval of a major third or longer, and an upper note which locates above and closest to the upper of the two notes NT and NC and apart from the upper of the two notes NT and NC by an interval of a major third or longer, and determines the selected two notes to be a lower confronting note NL and an upper confronting note NH, the note NL and the note NH sandwiching the two notes NT and NC from below and from above, respectively.

(4) The step S6 calculates a note X which is five semitones below the lower confronting note NL, adjust the notes, if any, in the input notes Nip which are lower than the calculated note X to the chord notes. The chord note adjustment is conducted by the method as described in connection with the type T1 adjustment using the chord note adjustment table C.

(D3) Type T3: Adjustment D3 using diminished chord notes.

When the step S5 has determined the Type 3 adjustment, the step S6 selects an adjustment table Tc for the diminished chord note adjustment from the chord constituent notes adjustment table TL to conduct the adjustment to the diminished chord notes. The adjustment table Tc provides chord constituent notes of the diminished chord. A diminished chord is frequently used as passing chord which connects two different chords smoothly. The system of the present invention, however, makes good use of the unique feeling (thrilling feeling, etc.) of a diminished chord itself so that the player can enjoy such a unique feeling, and the system also conducts the diminished chord note adjustment utilizing the nature of the diminished chord that it has no particular tonality and can be used fairly freely.

The diminished chord note adjustment table Tc describes the constituent notes of a diminished chord on the root note which is a semitone higher than the basic chords, namely the normalized root note of the diminished chord is C# while the normalized root notes of the basic chords are all C, as the diminished chords frequently used with the basic chords in progression has a root note which is a semitone higher than the root notes of the basic chords. For example, the chord constituent notes of a C#dim7 are C#, E, G and Bb.

When the adjustment to the diminished chord notes is being conducted, the step S6 selects, from the diminished chord note adjustment table Tc, a set of notes constituting a diminished chord on the root note which is a semitone higher than the root note of the chord represented by the chord data Cd (for example, where the chord data Cd indicates CM7, the notes constituting the C#dim) and develops the selected notes within the note range Ar determined at the step S3, thereby providing the adjustment table for the diminished chord note adjustment. Using thus developed adjustment table, the note adjustment by the diminished chord notes is conducted for the input notes Nip in the similar manner described in connection with the type T1 adjustment D1 by the basic chord notes. Thus, for example, where the chord represented by the chord data Cd is CM7, the diminished chord will be C#dim, and notes C#4, E4, G4, Bb4, C#5, E5, G5, Bb5 and so forth will be obtained.

(D4) Type T4: Adjustment D4 using approach chord notes.

When the step S5 has determined the Type 4 adjustment, the step S6 selects an adjustment table Td for the approach chord note adjustment from the chord constituent note adjustment table TL to conduct the adjustment to the approach chord notes. The approach chord note adjustment harmonizes the played notes using approach notes to constitute an approach chord in the chord progression to introduce a more natural and comfortable harmony line, as all the approach notes constituting an approach chord can resolve into some of the notes of the basic chords.

The approach chords are classified into three groups, a dominant approach group, a chromatic approach group and a scale approach group. The system of the embodiment uses the chords of the dominant approach group and the chords of the scale approach group. With these two groups, a melody which uses, as an approach note, the b9th note, the 9th note, the #9th note, the 11th note, the #11th note, the b13th note, the 13th note, the b7th note or the 7th note of the basic chord can be harmonized with an approach chord, wherein the most appropriate approach chord is inherently determined for each of the notes.

The dominant approach group can be further subdivided into three subgroups, an altered dominant approach, a diminished approach and a dominant approach. Where the b13th note, the b7th note or the #9th note of the basic chord is used as the top note, it is the altered dominant approach, where the 7th note, the 9th note or the 11th note of the basic chord is used as the top note, it is the diminished approach, and where the 13th note is used as the top note, it is the dominant approach.

The chromatic approach group can be used at any occasion where the melody or the musical progression approaches a chord note chromatically, the dominant approach group should preferably be used where the dominant approach group can be used, and the chromatic approach should be used as a second best application. Consequently, the use of the chromatic approach would be preferable for the #11th note and the b9th note of the basic chord.

In the case of an approach chord, the chord may be arbitrarily inverted (moving each of the chord constituent notes upward or downward by an amount of an octave) and any note can be omitted. And further, musical grammar permits that an approach chord may not necessarily solve into a basic chord immediately.

The approach chord note adjustment table Td describes the b9th note, the 9th note, the #9th note, the 11th note, the #11th note, the b13th note, the 13th note, the b7th note and the 7th note of the basic chord of each type, and is used to generate an approach chord note in the following procedure.

(1) The step S6 selects, from the approach chord note adjustment table Td, a note which is closest to the top note among the input notes Nip, and allots the selected note to the top note. This determines the kind of approach chord.

(2) Taking a middle note between the bottom note and the top note of the input notes Nip as a border, the lower side of the border is formed with a basic chord note table CH and the upper side of the border is formed with an approach chord notes each of which is to resolve into each basic chord constituent note according to the kind of approach chord determined in the above sub-step (1) to construct an adjustment table for this procedure.

(3) Using this constructed adjustment table, the input notes Nip are adjusted to approach chord notes applying the procedure as described in connection with the type T1 chord note adjustment. According to this procedure, for example, where the chord data Cd indicates the chord movement from CM7 to BM7, approach chord notes C4, E4, G4 (these three in the lower side), and A#4, B4, D#5, F#5 (these four in the upper side) will be generated.

(D5) Type T5: Adjustment D5 using fourth interval built-up chord notes.

When the step S5 has determined the Type 5 adjustment, the step S6 selects an adjustment table Te for the fourth interval built-up chord note adjustment from the chord constituent note adjustment table TL to conduct the adjustment to the fourth interval built-up chord notes. The fourth interval built-up chord note adjustment harmonizes the played notes using fourth interval built-up chord notes which are characterized in that there are two adjacent notes which are apart from each other by an interval of fourth. As a fourth interval built-up chord is established if there are some fourth interval gaps in the series of notes, the fourth interval built-up chord note adjustment table Te describes in the normalized key (i.e. CM) each type of chord with a series of chord constituent notes which contain fourth interval gaps as far as possible. The algorithm for the procedure is designed to preferentially select such notes at the fourth interval gap, and the procedure is conducted in the similar way as explained in connection with the procedure of the type T1 chord note adjustment. According to the fourth interval built-up chord note adjustment, for example, where the chord data Cd indicates BM7, fourth interval built-up chord notes C4, A4, D5, F#5, B5 and E6 will be generated.

(D6) Type T6: Adjustment D6 using upper structure triad notes.

When the step S5 has determined the Type 6 adjustment, the step S6 selects an adjustment table Tf for the upper structure triad note adjustment from the chord constituent note adjustment table TL to conduct the adjustment to the upper structure triad notes. There are plural upper structure triads available for each basic chord. As the upper structure triad is characterized in that it firmly constitutes a triad, a set of notes to be generated should consist at least of four notes including one note from the basic chord and three notes of the upper structure triad. The upper structure triad notes adjustment table Tf describes in the normalized key (i.e. CM) each type of chord with a series of chord constituent notes including highest notes, each of the upper structure triads conceivable from the basic chord.

When the adjustment to the upper structure triad notes is being conducted, the step S6 selects, from the upper structure triad note adjustment table Tf, a set of notes constituting an upper structure triad of the chord type as designated by the chord data Cd, shifts the selected notes according to the root of the chord as designated by the chord data Cd, and develops the shifted notes within the note range Ar determined at the step S3 to constitute the adjustment table for use. The step S6 then selects, from this adjustment table for use, a note which is closest to the highest note among the input notes Nip, and allots the selected note to the highest input note. Thus, the kind of upper structure triad is now determined.

Next, a "note Y" will be pointed at five semitones below the lowest note of the upper structure triad of the determined kind, and where there is a note lower than the note Y in the input notes Nip, such an input note will be adjusted to a chord note. To the chord note adjustment, the procedure explained in the type T1 chord note adjustment using the adjustment table C will be applied. Thus, for example, where the chord data Cd indicates (DM on) CM7, upper structure triad notes C4, B4, D5, F#5 and A5 will be generated.

The above described five types T2-T6 of harmonization procedures may be called substitution of the chords containing notes other than the chord constituent notes of the basic chords and usable along with the basic chords, for the basic chords represented by the chord data Cd. More specifically, the harmonization type T2 is the harmonization by using tension chords of the professional piano position, and the harmonization type T3 is the harmonization by using diminished chords. The harmonization types T4-T6 are the harmonizations by using approach chords, fourth interval built-up chords and upper structure triads, respectively. The input notes Nip are adjusted to the chord constituent notes of the respective adjusted chords using the "adjustment tables for use" correspondingly constituted (formed) from the adjustment tables Ta-Tf for the respective types of adjustment procedures.

After the chord note adjustment step S6, the processing flow proceeds to a step S7 to conduct supplemental processing for enhancing stableness of the chords. Where the step S2 has judged there is an exceptional bottom note, this supplemental processing outputs, corresponding to the exceptional bottom note, a note which is one of the root notes of the basic chords, and is lower than the lowest notes among the notes adjusted in the step S6 and closest to the exceptional bottom note. However, in the case of the type T3 adjustment using diminished chord notes, the root note of the diminished chord will be output as such a note. Thereafter, a step S8 outputs the chord notes from the processing in the step S7 as output chord notes Nop to the function block M4 for outputting the adjusted notes, and the chord note adjustment processing comes to an end.

Various Embodiments

While several preferred embodiments have been described and illustrated in detail herein above with reference to the drawings, it should be understood that the illustrated embodiments are just for preferable examples and that the present invention can be practiced with various modifications without departing from the spirit of the present invention. For example, with respect to the correspondence between the types T1-T6 of chord adjustment and the depressed key patterns P1-P6, a default setting may preferably be made at the start of the system and may preferably be customized by the player's manipulation of the pattern table allotment switch in the panel control unit 6. Further, the panel control unit 6 may include a basic chord note preference switch which can cancel the operation of the adjustment procedures other than the basic chord note adjustment D1 using the adjustment table Ta so that key depressions in any patterns will result in the same procedure of type T1 of adjustment D1 using the basic chord notes.

In addition to the chord progression data files from the sequencer, there may be provided some music data files in SMF or MP3 protocol having contents which musically match the chord progressions so that the improvisation assist mode will be operated with such a music file being played back as BGM. The chord progression may be made shiftable (i.e. transposable) so that the player can alter the designated key arbitrarily.

What is claimed is:

1. An electronic keyboard musical instrument for assisting in improvisation comprising:

a musical keyboard including white keys and black keys;

an input note acquiring device for acquiring input note data representing notes input by a number of keys simultaneously depressed in the keyboard;

a key pattern judging device, provided with a number of predetermined patterns of depressed keys, for judging which of the patterns the simultaneously depressed keys exhibit based on the acquired input note data;

a harmonization type determining device, provided with a number of types of harmonization, for determining a type of harmonization from among the provided types of harmonization for the notes of the depressed keys based on the judged patterns of the depressed keys, each type of harmonization determining chord notes for the type of harmonization; and a note adjusting device for adjusting the input note data to chord data which represent chord notes as determined by the type of harmonization, wherein the types of harmonization correspond to different types of chord.

2. An electronic keyboard musical instrument as claimed in claim 1, further comprising:

a chord progression providing device for providing chord progression data;

a plurality of chord adjustment tables provided respectively corresponding to the types of harmonization, each adjustment table for indicating adjustment of input notes inadequate to constitute a chord to adequate notes to constitute a chord for the corresponding type of harmonization in view of musical grammar; and an adjustment table designating device for designating an adjustment table to be applied to the determined type of harmonization, wherein the note adjusting device prepares an adjustment table to be used in adjusting the input notes to match the chord data in the chord progression data based on the determined type of harmonization.

3. An electronic keyboard musical instrument as claimed in claim 1, wherein the key pattern judging device judges, when the depressed keys include two highest keys which are apart from each other by an interval larger than a predetermined amount, the pattern of the simultaneously depressed keys by excluding the higher of the two.

4. An electronic keyboard musical instrument as claimed in claim 1, wherein the relationship between the patterns of the depressed keys and the types of harmonization to be used in the harmonization type determining device can be set by a user of the instrument.

5. An electronic keyboard musical instrument as claimed in claim 1, wherein the patterns of the depressed keys are featured by the arrangement of the white keys and the black keys among the depressed keys in general.

6. An electronic keyboard musical instrument as claimed in claim 1, wherein the patterns of the depressed keys are featured by the location of the black keys among the depressed keys.

7. An electronic keyboard musical instrument as claimed in claim 1, wherein the patterns of the depressed keys are featured by the number of black keys among the depressed keys.

8. An electronic keyboard musical instrument as claimed in claim 1, wherein the types of harmonization include basic chord notes, tension voicing, a diminished chord, an approach chord, a fourth interval built-up chord, an upper structure triad.

9. A non-transitory computer readable storage medium storing a computer program executable by a computer coupled to a musical keyboard including white keys and black keys and functioning as an electronic keyboard musical instrument, the computer program containing instructions for:

acquiring input note data representing notes input by a number of keys simultaneously depressed in the keyboard;

providing a number of predetermined patterns of depressed keys;

judging which of the provided patterns the simultaneously depressed keys exhibit based on the acquired input note data;

providing a number of types of harmonization;

determining a type of harmonization from among the provided types of harmonization for the notes of the depressed keys based on the judged patterns of the depressed keys, each type of harmonization determining chord notes for the type of harmonization; and adjusting the input note data to chord data which represent chord notes as determined by the type of harmonization, wherein the types of harmonization correspond to different types of chord.

10. A non-transitory computer readable storage medium as claimed in claim 9, wherein the types of harmonization include basic chord notes, tension voicing, a diminished chord, an approach chord, a fourth interval built-up chord, an upper structure triad.

11. An electronic keyboard musical instrument for assisting in improvisation comprising:

a musical keyboard including white keys and black keys;

a chord progression providing device for providing chord progression data;

an input note acquiring device for acquiring input note data representing notes input by a number of keys simultaneously depressed in the keyboard;

a key pattern judging device, provided with a number of predetermined patterns of depressed keys, for judging which of the patterns the simultaneously depressed keys exhibit based on the acquired input note data;

a chord change table for changing the chord progression data to represent another chord which matches the judged depressed key pattern; and a note adjusting device for adjusting the input note data to chord data which represent chord notes as represented by the changed chord progression data.

12. A non-transitory computer readable storage medium storing a computer program executable by a computer coupled to a musical keyboard including white keys and black keys and functioning as an electronic keyboard musical instrument, the computer program containing instructions for:

providing chord progression data;

acquiring input note data representing notes input by a number of keys simultaneously depressed in the keyboard;

providing a number of predetermined patterns of depressed keys;

judging which of the patterns the simultaneously depressed keys exhibit based on the acquired input note data;

changing the chord progression data to represent another chord which matches the judged depressed key pattern; and adjusting the input note data to chord data which represent chord notes as represented by the changed chord progression data.

* * * * *